US007288060B2

(12) United States Patent
Takahashi

(10) Patent No.: US 7,288,060 B2
(45) Date of Patent: Oct. 30, 2007

(54) CENTRIFUGAL SEPARATOR

(75) Inventor: Hiroyuki Takahashi, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 11/336,847

(22) Filed: Jan. 23, 2006

(65) Prior Publication Data

US 2006/0166801 A1 Jul. 27, 2006

(30) Foreign Application Priority Data

Jan. 24, 2005 (JP) ..... P 2005-014931

(51) Int. Cl.
*B04B 7/06* (2006.01)

(52) U.S. Cl. ..... 494/12; 494/16

(58) Field of Classification Search ..... 494/1, 494/7–12, 16–21, 84; 210/85, 144, 363
See application file for complete search history.

(56) References Cited

U.S. PATENT DOCUMENTS 3,633,041 A * 1/1972 Koskela ..... 307/119
3,699,287 A * 10/1972 Stahl et al. ..... 200/61.45 R
5,280,975 A * 1/1994 Tscheu et al. ..... 292/251
6,241,650 B1 * 6/2001 Letourneur ..... 494/11
6,334,841 B1 * 1/2002 Letourneur ..... 494/11
6,602,178 B2 * 8/2003 Inaniwa et al. ..... 494/7
7,104,944 B2 * 9/2006 Fujimaki et al. ..... 494/10
2006/0166801 A1 * 7/2006 Takahashi ..... 494/12
2006/0178253 A1 * 8/2006 Takahashi ..... 494/12

FOREIGN PATENT DOCUMENTS

DE 2816395 A1 * 10/1979
JP 60-20753 6/1985
JP 07275738 A * 10/1995
JP 9-187428 7/1997
JP 2001-87677 4/2001

* cited by examiner

*Primary Examiner*—Charles E. Cooley
(74) *Attorney, Agent, or Firm*—Mattingly, Stanger, Malur & Brundidge, P.C.

(57) ABSTRACT

A centrifugal separator is configured such that a switching unit adapted to be brought into electrical conduction or electrical nonconduction is electrically connected in a drive power supply line between a motor drive circuit of a control unit and a motor winding wire, and that the switching unit is controlled to be brought into nonconduction when a door is opened.

27 Claims, 3 Drawing Sheets

CENTRIFUGAL SEPARATOR

BACKGROUND OF THE INVENTION

1. Field of the Invention

The present invention relates to a structure for securing the electrical safety of a centrifugal separator.

2. Description of the Related Art

The centrifugal separator is configured so that a rotor caused through a tube and a bottle to hold a sample to be separated is accommodated in a rotor chamber (rotating chamber), and that the rotor is rotated at high speed by a drive unit, such as a motor, in a case where an opening portion of the rotor chamber is hermetically closed by a door, to thereby separate and purify the sample held by the rotor. The rotational speed of the rotor varies with the use thereof. Generally, there are provided families of products having rotational speeds that widely range from a relatively low speed, the maximum value of which is about several thousands revolutions per minute (rpm), to a high speed, the maximum value of which is about 150,000 rpm.

FIG. 6 shows the configuration of a known centrifugal separator. The centrifugal separator comprises a motor housing (casing) 5 of a motor 5*a* serving as a rotary drive source, a rotating spindle (a shaft) 5*b* rotatably connected to the motor 5*a*, a rotor 1 fixed to the rotating shaft 5*b* and adapted to hold a sample to be separated, a rotor chamber 2 adapted to accommodate the rotor 1 and to have an opening portion 2*a* in the top surface thereof, a door 3 openably/closeably provided in the opening portion 2*a* of the rotor chamber 2, a door lock mechanism 4 adapted to restrict the opening/closing of the door 3, a door opening/closing detector 12 adapted to detect the opening/closing of the door 3, and a control unit 60 adapted to control the motor 5*a* and the door lock mechanism 4. The motor housing 5, the rotor chamber 2, the door lock mechanism 4, and the control unit 60 are accommodated in a casing (frame) 10.

When the door 3 of the rotor chamber 2 is opened in such a centrifugal separator, a user may touch the rotating shaft 5*b* of the motor 5*a* and the rotor 1 that may electrically be conducted to the rotating shaft 5*b*. Thus, generally, an electrically insulating layer is provided between the winding of the motor 5*a* and the rotating shaft 5*b* to thereby prevent a user from getting an electrical shock.

Further, to prevent a power supply voltage from being generated on the rotating shaft 5*b* even when such an insulating layer may cause dielectric breakdown, an electric shock guard means is doubled by electrically grounding the motor housing 5 of the motor 5*a* through a ground connection wire 8. Usually, the casing 10 of the centrifugal separator is connected to a ground connection wire 9. Thus, the ground connection wire 8 of the motor housing 5 is electrically connected to a part of the casing 10 of the centrifugal separator placed in the vicinity of the motor housing 5. Incidentally, the value of a leakage current of the centrifugal separator is limited to a value, which is predetermined according to JIS (Japanese Industrial Standards) safety standard or to IEC (International Electrotechnical Commission) safety standard not to seriously affect a human body, or less (for instance, 3.5 mA or less) Also, it is required to place a plurality of electric shock guard means at members of a centrifugal separator, which have possibilities of being touched by users. Also, it is prescribed that in a case where an insulation part is used as the electric shock guard means, the insulation part should have a high withstand voltage (for instance, 1300V or higher).

However, in some condition in which the centrifugal separator is used, a user may use the centrifugal separator in an environment in which no grounding equipment is provided. In this case, the aforementioned electric shock guard means utilizing the grounding cannot be employed. Thus, an insulation transformer 13 is used as another ordinary electric shock guard means, as illustrated in FIG. 5, to thereby ensure safety. Also, sometimes, a method of performing double insulation or reinforced insulation on the casing of the motor itself by using an insulating layer to insulate the winding of a motor is performed as a still another means for assuring safety.

Incidentally, regarding the related art, JP-UM-B-60-20753 discloses the technique of preventing occurrence of an electric shock by providing an electrical insulating layer between the rotor winding and the rotating shaft of a motor, or what is called a double insulation technique of constructing also a motor casing by an insulating material. Further, JP-A-9-187428 discloses the technique of preventing the generation of a leakage current by using the insulation transformer. Furthermore, JP-A-2001-87677 discloses the technique of constituting a centrifugal separation rotor attached to the rotating shaft of a motor by an insulating material to thereby ensure safety in a case where a user touches the rotor and so on.

However, the structure using the aforementioned insulation transformer 13, and the structure of the motor 5*a*, to which the double insulation or the reinforced insulation is applied, are advantageous in a case where the ground connection wire 9 is not ground-connected, such structures have a problem that the structures cause an increase in the cost of the centrifugal separator. Further, the technique described in the aforementioned JP-A-2001-87677 is subjected to a constraint that the process material of the rotor is an insulating material. Thus, it is difficult to combine a rotor, which is made of a generally used metallic material, with a centrifugal separator body.

Furthermore, when the aforementioned insulation transformer is used or when the double insulation or the reinforced insulation of the motor is performed thereon, not only the employment of a plurality of electric shock guards but that of countermeasures to limit the value of a leakage current (an electric current flowing through the body of a user when the user touches the rotor) generated through floating capacity (stray capacitance) to a leakage current value, which is determined according to the safety standards, or less is performed.

SUMMARY OF THE INVENTION

Accordingly, an object of the invention is to provide a centrifugal separator enabled by employing a relatively simple configuration to reduce a leakage current and realize double prevention of occurrence of an electric shock without using the high-cost insulation transformer and without the double insulation or the reinforced insulation structure of the motor and without additional countermeasures to reduce a leakage current.

The above and other objects and novel features of the invention will become more apparent from the following description and the accompanying drawings.

Inventors of the present invention focus attention on the following specificities of the centrifugal separator and have created the present invention. That is, usually, the centrifugal separator is configured so that during an operation thereof, the door of the rotor chamber is locked and is inhibited from opening, thereby to ensure safety against unexpected mechanical damage in operation. Therefore, the inventors focus attention on the fact that because the door is closed, a user of the centrifugal separator cannot touch the rotating shaft of the motor and the rotor in operation, so that occurrence of an electrical shock due to the user's touch on the motor or on the rotor can be prevented. Consequently, the electric shock guard can be doubled. Thus, the grounding of the motor housing can be omitted. Meanwhile, when the centrifugal separator is stopped, a user can open the door and touch the rotor and so on. Thus, the motor housing having neither a double insulation structure nor a reinforced insulation structure needs ground connection. However, when the centrifugal separator is stopped, it is unnecessary to rotate the motor, so that the separation of the motor drive circuit from the power supply can be utilized as an electric shock guard means. Therefore, in both of a case where the centrifugal separator is operated, and a case where the centrifugal separator is stopped, this electric shock guard means is added to the insulation structure provided between the winding wire and the rotating shaft of the motor, so that a plurality of electric shock guard means can be realized.

Outlines of the representative aspects of the invention disclosed in the present application are described as follows.

(1) According to an aspect of the invention, there is provided a centrifugal separator having a motor housing that incorporates a motor serving as a rotary drive source; a rotating shaft connected to the motor; a rotor fixed to the rotating shaft and adapted to hold a sample to be separated; a rotor chamber adapted to accommodate the rotor and to have an opening portion in a top surface thereof; a door openably/closeably provided in the opening portion of the rotor chamber; a door lock mechanism adapted to restrict the opening/closing of the door; a control unit adapted to control the motor and the door lock mechanism; a casing adapted to accommodate the motor housing, the rotor chamber, the door lock mechanism, and the control unit, and to have an open part at the opening portion in the top surface of the rotor chamber so that the door is openably and closeably provided in the open part; and a switching unit, which is adapted to be brought into electrical conduction or electrical nonconduction, being electrically connected to a line for supplying power to the motor, the line connecting the control unit and the motor, wherein, when the door lock mechanism does not lock the door, the switching unit is brought into electrical nonconduction.

(2) An embodiment of the centrifugal separator of the invention described in the item (1) features that the switching unit is controlled by the control unit to be brought into electrical nonconduction when the door lock mechanism does not lock the door.

(3) According to another aspect of the invention, there is provided a centrifugal separator having a motor housing that incorporates a motor serving as a rotary drive source; a rotating shaft connected to the motor; a rotor fixed to the rotating shaft and adapted to hold a sample to be separated; a rotor chamber adapted to accommodate the rotor and to have an opening portion in a top surface thereof; a door openably/closeably provided in the opening portion of the rotor chamber; a door opening/closing detector adapted to detect opening/closing of the door; a control unit adapted to control the motor; a casing adapted to accommodate the motor housing, the rotor chamber, the door lock mechanism, and the control unit, and to have an open part at the opening portion in the top surface of the rotor chamber so that the door is openably and closeably provided in the open part; and a switching unit, which is adapted to be brought into electrical conduction or electrical nonconduction, being electrically connected to a line for supplying power to the motor, the line connecting the control unit and the motor, wherein the switching unit is controlled to be brought into nonconduction when the door is opened.

(4) An embodiment of the centrifugal separator of the invention described in the item (3) features that when the door opening/closing detector detects the opening of the door, the switching unit is brought into nonconduction.

(5) An embodiment of the centrifugal separator of the invention described in one of the items (1) to (4) features that when the control unit does not control the motor, the switching unit is brought into nonconduction.

(6) An embodiment of the centrifugal separator of the invention described in one of the items (1) to (5) features that the switching unit is an electromagnetic switch.

(7) An embodiment of the centrifugal separator of the invention described in one of the items (1) to (6) features that the motor housing is electrically separated from the casing and is accommodated in the casing.

(8) An embodiment of the centrifugal separator of the invention described in one of the items (1) to (7) features that the rotor is made of a metallic material.

With the configuration of the centrifugal separator according to the invention described in the item (1), a switching unit adapted to be brought into electrical conduction or into electrical nonconduction is electrically connected in a motor drive power supply line connecting the control unit and the motor. When the door of the centrifugal separator is opened in a state in which a user can touch the rotor and the rotating shaft of the motor, the switching unit is made to be brought into nonconduction. Consequently, the electric shock guard means can be doubled by causing the nonconduction of electricity in the switching unit in addition to the insulation of the motor. Thus, the necessity for performing the addition of the insulation transformer and the double insulation or the reinforced insulation of the motor, which are needed by the related art, can be eliminated. Consequently, a low-cost centrifugal separator having a simple configuration can be provided. Meanwhile, when the motor is operated, the switching unit is brought into conduction. However, the door of the centrifugal separator is closed and is locked so that a user cannot touch the rotor and the rotating shaft of the motor. Thus, the electric shock guard means can be doubled by adding the locking of the door to the insulation of the motor.

Also, according to the invention described in the item (6), especially, an electromagnetic switch is used as the switch unit. Thus, when the electromagnetic switch is brought into nonconduction, a high withstand voltage (for example, 1300V or higher) developed between the terminals of the switch, which voltage is required to serve as the electric shock guard means, can easily be obtained. Further, as compared with a switch unit implemented by an electronic switch, such as a transistor, the floating capacity (stray capacitance) can be reduced. Thus, the suppression of the value of the leakage current, which is generated when a user touches the rotor and the rotating shaft of the motor during stopped, to a value, which is determined according to the JIS standard and the IEC standard, or less can be facilitated.

DETAILED DESCRIPTION OF THE PREFFERED EMBODIMENTS

Figure 1:
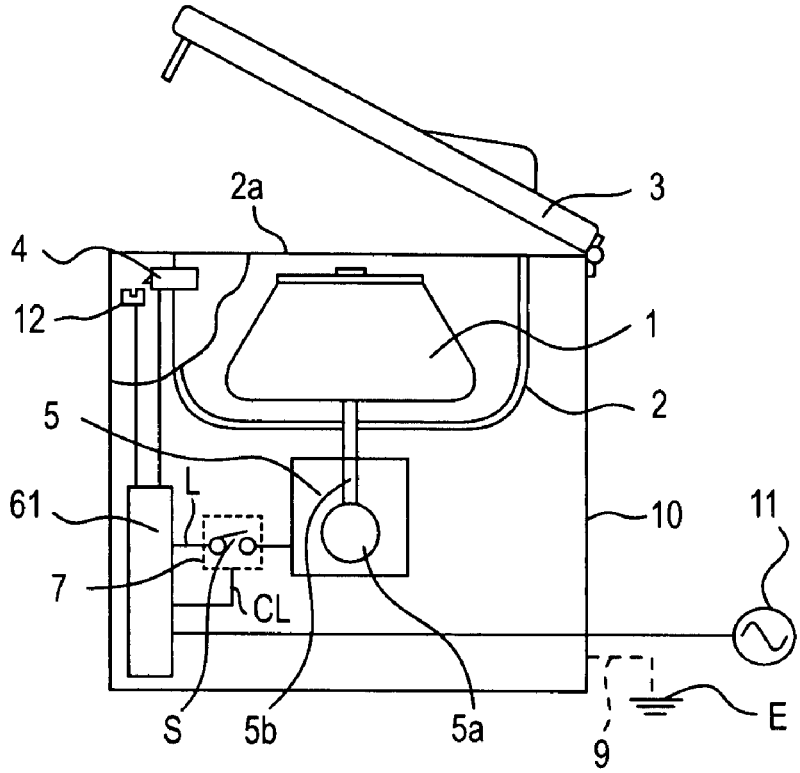
FIG. 1 is a view illustrating the configuration of a centrifugal separator according to an embodiment of the invention.

Hereinafter, embodiments of the invention are described in detail with reference to the accompanying drawings. Incidentally, same reference numerals designate members having the same functions throughout figures illustrating the embodiment. Thus, redundant descriptions of such members are omitted herein. Further, members having the same functions as those of corresponding members of the related art are denoted by the same reference numerals as those denoting the corresponding members.

Figure 2:
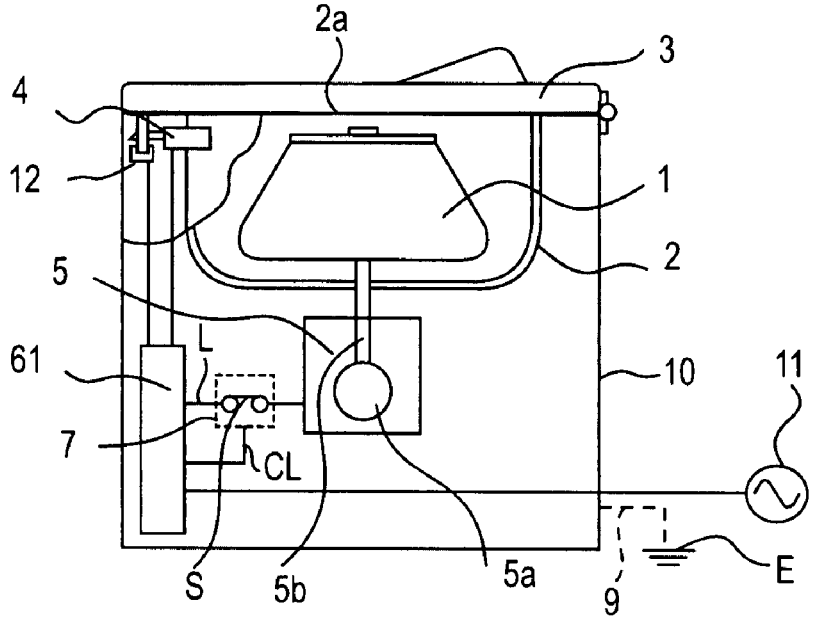
FIG. 2 is a view illustrating a state, in which a door is closed in the centrifugal separator according to the invention shown in FIG. 1.
Figure 6:
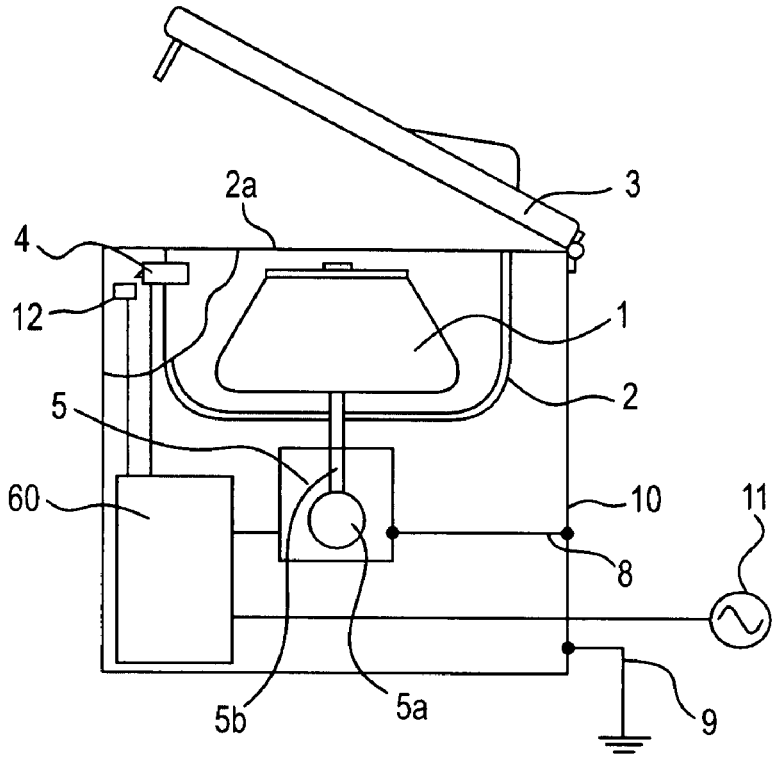
FIG. 6 PRIOR ART
FIG. 6 is a view illustrating the configuration of another example of a related centrifugal separator.

FIGS. 1 and 2 are views illustrating the configuration of a centrifugal separator according to an embodiment of the invention. Particularly, FIG. 1 is a view illustrating a state in which a switching unit 7 is in a nonconductive state, and in which a motor 5*a* is stopped, so that a rotor 1 does not rotate. FIG. 2 is a view illustrating a state in which the switching unit 7 is in a conductive state and in which the motor 5*a* rotates, so that the rotor 1 is rotated. The centrifugal separator has a metallic casing (frame) 10, which is, for example, quadrangular in cross section viewed from top. The centrifugal separator also has a metallic motor housing (casing) 5 that incorporates the motor 5*a*, which serves as a rotary drive source. The centrifugal separator also has a metallic rotating spindle (shaft) 5*b* rotatably connected to the motor 5*a*, the rotor 1 that is made of a metallic material (for instance, an aluminum based alloy) and that holds a sample to be separated, a rotor chamber 2 that accommodates the rotor 1 and has an opening portion 2*a* in the top surface thereof, a door 3 capable of being opened and closed and provided in the opening portion 2*a* of the rotor chamber 2 that is formed in the casing 10, a door lock mechanism 4 adapted to restrain the opening/closing of the door 3, a door opening/closing detector 12 adapted to detect the opening/closing of the door, the switching unit 7 electrically connected to a supply line L of drive power for the motor 5*a*, and a control unit 61 adapted to control the motor 5*a*, the door lock mechanism 4, and the switching unit 7. These figures illustrate a state in which the casing 10 is not electrically connected to the earth E. Further, this embodiment of the invention is not provided with a ground connection wire (corresponding to the connection wire 8 shown in FIG. 6) adapted to electrically connect the motor housing 5 to the casing 10.

Figure 3:
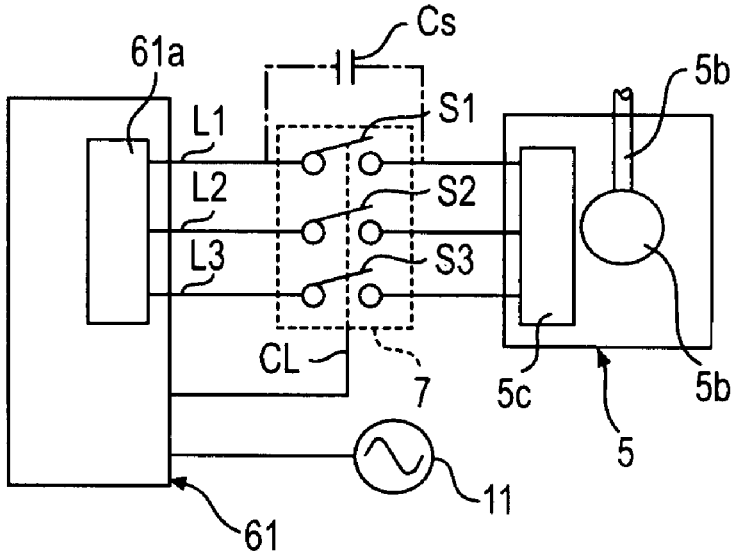
FIG. 3 is a view illustrating the configuration of a primary part of an example of the centrifugal separator shown in FIG. 1 according to the invention.

The motor 5*a* is constituted by, for example, a three-phase induction motor activated by a three-phase ac power supply that provides a voltage of 300V. An insulating layer is formed between the winding wire and the iron core of the motor 5*a* or on the outer peripheral surface of the rotating shaft 5*b* of the motor 5*a*. FIG. 3 illustrates a more practical connection relation between the motor 5*a* and the switching unit 7.

As shown in FIG. 3, the control unit 61 has a motor drive circuit 61*a*. The motor drive circuit 61*a* includes an inverter system and converts an ac power supply voltage supplied from an ac power supply 11, which is constituted by, for example, a commercial ac power supply providing a voltage of 100V or 200V (50/60 Hz), to a three-phase ac power supply voltage of 300V (5 Hz to 2.6 kHz) by using an inverter 61*a*. Thus, the three-phase ac voltages are outputted to lines L1, L2, and L3.

Figure 4:
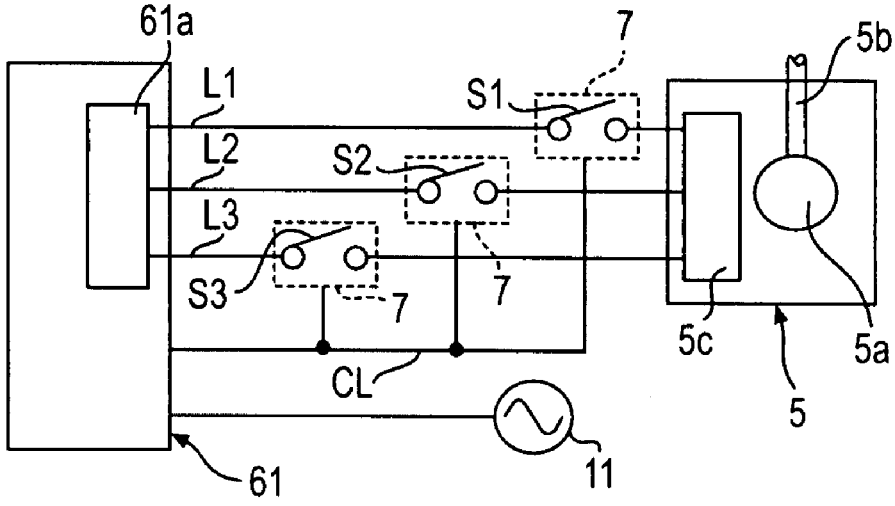
FIG. 4 is a view illustrating the configuration of a primary part of another example of the centrifugal separator shown in FIG. 1 according to the invention.
Figure 5:
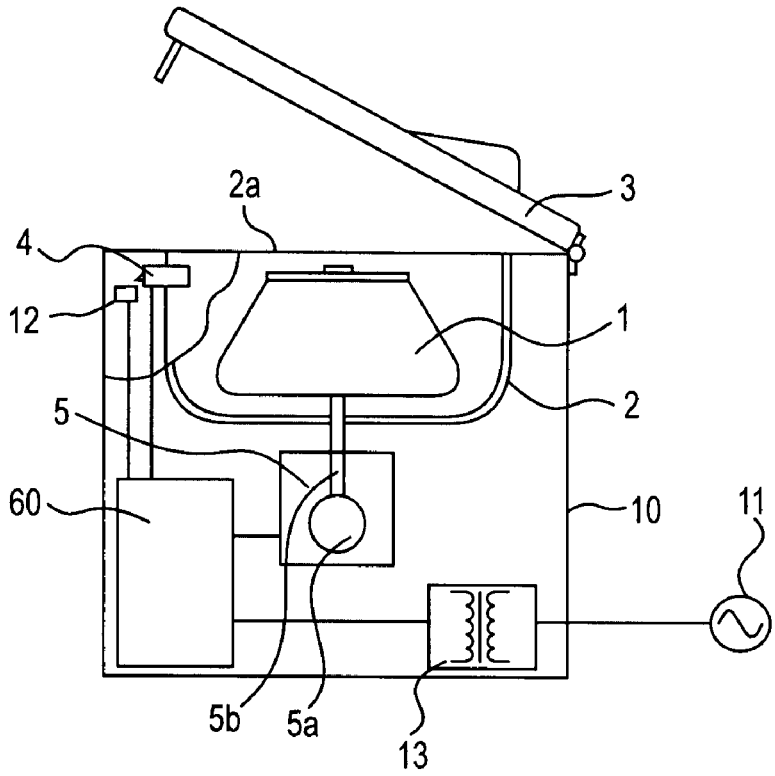
FIG. 5 PRIOR ART
FIG. 5 is a view illustrating the configuration of an example of a related centrifugal separator.

The switching unit 7 has a property of causing the conduction of electricity in (or connection of) or the non-conduction of electricity in (or interruption of) the line L in response to a control signal applied to the control terminal CL thereof. The switching unit 7 is constituted by an electromagnetic switch (an electromagnetic relay) in the preferred embodiment. FIG. 3 shows an example using the electromagnetic switch 7 of the triple throw type (the three-contact-point type). Three contact points S1, S2, and S3 of the electromagnetic switch 7 serving as the switching unit are connected to the drive power supply lines L1, L2, and L3, respectively. Three-phase ac power is supplied to a three-phase winding wire 5*c* of the induction motor 5*a* through these contact points. The control of the conduction of electricity in(or the connection of) or the nonconduction of electricity in (or the interruption of) each of the switches S1, S2, and S3 of the electromagnetic switch 7 is performed in response to a control signal to be applied to the control terminal CL of the electromagnetic switch 7 by the control unit 61. FIG. 4 illustrates another example of the configuration employing an electromagnetic switch as the switching unit 7. The switching switch 7 shown in FIG. 4 is an example of using three electromagnetic switches of the one-contact-point type (S1, S2, and S3). Thus, the centrifugal separator can be configured similarly to the case shown in FIG. 3.

Next, an operation of the embodiment according to the invention is described below. The switching unit (the electromagnetic switch) 7 is controlled by the control unit 61 to be brought into a conduction state when the door is put into a closed state, as shown in FIG. 2, at the stage of an operation of the centrifugal separator. When the door opening/closing detector 12 detects the closed state of the door 3 after the door 3 is closed, or when the door 3 is locked by the door lock mechanism 4 after the door 3 is closed, each of the contact points S1, S2, and S3 of the electromagnetic switch 7 shown in FIG. 3 is put into a conduction (connection) state. Thereafter, the motor drive circuit 61*a* supplies a high three-phase ac power supply voltage (for instance, 300V) to the winding wire 5*c* of the motor 5*a* through the supply line L to thereby rotate the motor 5*a*. That is, the voltage generated by the ac power supply 11 is boosted by the inverter 61*a* configured in the control unit 61 and is supplied to the winding wire 5*c* of the motor 5*a*. Therefore, during an operation of the motor 5*a*, the electric shock guard means provided between the ac power supply 11 and each of the rotor 1 and the motor housing 5 is only the insulation provided on the motor 5*a*. However, during the operation of the motor 5*a*, the door 3 is closed and is locked. Thus, a user of the centrifugal separator cannot touch the motor housing 5, the rotating shaft 5*b* of the motor 5*a*, and the rotor 1. On the other hand, the motor housing 5 is not electrically connected to the casing 10. This means that a second electric shock guard means is provided therein.

On the other hand, in a case where the operation of the centrifugal separator is stopped and where the door 3 is opened, for example, in a case where the control unit 61 cancels the lock by the door lock mechanism 4 and where the user opens the door 3, the control unit 61 receives a lock cancellation signal instructing the cancellation of the lock by the door lock mechanism 4 or an opening signal sent from the door opening/closing detector 12 and outputs a control signal to the control terminal CL thereby bringing each of the contact points S1, S2, and S3 of the switching unit 7 shown in FIG. 3 into a nonconduction state (an interruption state) and thereby interrupting the electric connection between the winding wire 5*c* of the motor 5*a* and the drive power supply. When the door 3 is opened, a user may touch the rotating shaft 5*b* of the motor 5*a* and the rotor 1 electrically conducted to the rotating shaft 5*b*. However, according to the invention, the electrical connection between the drive power supply and the motor winding wire 5*c* is interrupted by the switching unit 7. Thus, in a state in which the door 3 is opened, the switching unit 7 functions as a second electric shock guard means.

Advantages of using the electromagnetic switch as the switching unit 7 inserted according to the invention are that the withstand voltage developed between both terminals of the switching unit 7 put in an opened state can be set at 1300V or higher, and that the floating capacity (the stray capacitance) Cs (see FIG. 3) between both terminals of the switching unit 7 in an interruption state (nonconduction state) can be made to be low. Especially, the use of the electromagnetic switch is advantageous in performing a high withstand voltage test on the centrifugal separator. Further, because of the low floating capacity Cs of the electromagnetic switch at the interruption, the use of the electromagnetic switch is advantageous in reducing a leakage current generated when a user touches the rotor or the rotating shaft of the motor 5*a*. In a case where it is sufficient to use a switching unit 7 having a relatively low withstand voltage, an electronic switch constituted by a semiconductor switch using a transistor other than the electromagnetic switch may be used as such a switching unit 7.

The control of the switching unit 7 may be performed by the control unit 61 when the opening/closing of the door 3 is detected by the door opening/closing detector 2. Alternatively, the control of the switching unit 7 may be performed by the control unit 61 when the lock of the door is performed by the door lock mechanism 4, or when the cancellation of the lock of the door is detected. Alternatively, the switching unit 7 may be controlled to be brought in nonconduction when the control unit 61 does not drive the motor 5*a*.

In a case where the centrifugal separator is used in an environment in which grounding equipment is provided, as illustrated in FIG. 2, the casing 10 of the body of the centrifugal separator may be connected to the earth E through the ground connection wire 9. As is apparent from the foregoing description, according to the invention, the switching unit is inserted into the path of the motor drive power supply wire, the control of the opening/closing, that is, the conduction/nonconduction of electricity in the switching unit is performed by the control unit adapted to drive the motor. Thus, the leakage current of the centrifugal separator can be reduced. Also, the electric shock guard means can be doubled. Thus, the desired object of the invention can be achieved by employing a relatively simple configuration without using the double insulation structure or the reinforced insulation structure in the iron core or the rotating shaft of the motor and without being constrained by the shape and the material of the rotor for the centrifugal separator.

Although the invention accomplished by the present inventors has been described according to the embodiments, the invention is not limited to the aforementioned embodiments. Various modifications may be made without departing the gist of the invention.

What is claimed is:

1. A centrifugal separator comprising:

a motor housing that incorporates a motor serving as a rotary drive source;

a rotating shaft connected to said motor;

a rotor fixed to said rotating shaft and adapted to hold a sample to be separated;

a rotor chamber adapted to accommodate said rotor and to have an opening portion in a top surface thereof;

a door openably/closeably provided in said opening portion of said rotor chamber;

a door lock mechanism adapted to restrict the opening/closing of said door;

a control unit adapted to control said motor and said door lock mechanism;

a casing adapted to accommodate said motor housing, said rotor chamber, said door lock mechanism, and said control unit, and to have an open part at said opening portion in said top surface of said rotor chamber so that said door is openably and closeably provided in said open part; and a switching unit, which is adapted to be brought into electrical conduction or electrical nonconduction, being electrically connected to a line for supplying power to said motor, said line connecting the control unit and the motor, wherein, when said door lock mechanism does not lock said door, said switching unit is brought into electrical nonconduction.

2. The centrifugal separator according to claim 1, wherein said switching unit is controlled by said control unit to be brought into electrical nonconduction when said door lock mechanism does not lock said door.

3. The centrifugal separator according to claim 2, wherein, when said control unit does not control said motor, said switching unit is brought into electrical nonconduction.

4. The centrifugal separator according to claim 2, wherein said switching unit is an electromagnetic switch.

5. The centrifugal separator according to claim 2, wherein said motor housing is electrically separated from said casing and is accommodated in said casing.

6. The centrifugal separator according to claim 2, wherein said rotor is made of a metallic material.

7. The centrifugal separator according to claim 1, wherein, when said control unit does not control said motor, said switching unit is brought into electrical nonconduction.

8. The centrifugal separator according to claim 7, wherein said switching unit is an electromagnetic switch.

9. The centrifugal separator according to claim 7, wherein said motor housing is electrically separated from said casing and is accommodated in said casing.

10. The centrifugal separator according to claim 5, wherein said rotor is made of a metallic material.

11. The centrifugal separator according to claim 1, wherein said switching unit is an electromagnetic switch.

12. The centrifugal separator according to claim 11, wherein said motor housing is electrically separated from said casing and is accommodated in said casing.

13. The centrifugal separator according to claim 11, wherein said rotor is made of a metallic material.

14. The centrifugal separator according to claim 1, wherein said motor housing is electrically separated from said casing and is accommodated in said casing.

15. The centrifugal separator according to claim 14, wherein said rotor is made of a metallic material.

16. The centrifugal separator according to claim 1, wherein said rotor is made of a metallic material.

17. A centrifugal separator comprising:

a motor housing that incorporates a motor serving as a rotary drive source;

a rotating shaft connected to said motor;

a rotor fixed to said rotating shaft and adapted to hold a sample to be separated;

a rotor chamber adapted to accommodate said rotor and to have an opening portion in a top surface thereof;

a door openably/closeably provided in said opening portion of said rotor chamber;

a door opening/closing detector adapted to detect opening/closing of said door;

a control unit adapted to control said motor;

a casing adapted to accommodate said motor housing, said rotor chamber, said door lock mechanism, and said control unit, and to have an open part at said opening portion in said top surface of said rotor chamber so that said door is openably and closeably provided in said open part; and a switching unit, which is adapted to be brought into electrical conduction or electrical nonconduction, being electrically connected to a line for supplying power to said motor, said line connecting the control unit and the motor, wherein said switching unit is controlled to be brought into nonconduction when said door is opened.

18. The centrifugal separator according to claim 17, wherein, when said door opening/closing detector detects the opening of said door, said switching unit is brought into electrical nonconduction.

19. The centrifugal separator according to claim 18, wherein, when said control unit does not control said motor, said switching unit is brought into electrical nonconduction.

20. The centrifugal separator according to claim 4, wherein said switching unit is an electromagnetic switch.

21. The centrifugal separator according to claim 18, wherein said motor housing is electrically separated from said casing and is accommodated in said casing.

22. The centrifugal separator according to claim 18, wherein said rotor is made of a metallic material.

23. The centrifugal separator according to claim 17, wherein, when said control unit does not control said motor, said switching unit is brought into electrical nonconduction.

24. The centrifugal separator according to claim 17, wherein said switching unit is an electromagnetic switch.

25. The centrifugal separator according to claim 17, wherein said motor housing is electrically separated from said casing and is accommodated in said casing.

26. The centrifugal separator according to claim 17, wherein said rotor is made of a metallic material.

27. The centrifugal separator according to claim 17, wherein said switching unit is controlled by said control unit to be brought into electrical nonconduction when said door is opened.

* * * * *